US006820748B2

(12) United States Patent
Fallon

(10) Patent No.: US 6,820,748 B2
(45) Date of Patent: Nov. 23, 2004

(54) VIBRATORY SCREENING MACHINE WITH STACKED AND STAGGERED SCREENING UNITS

(75) Inventor: Thomas M. Fallon, East Aurora, NY (US)

(73) Assignee: Derrick Manufacturing Corporation, Buffalo, NY (US)

( * ) Notice: Subject to any disclaimer, the term of this patent is extended or adjusted under 35 U.S.C. 154(b) by 0 days.

(21) Appl. No.: 10/174,291

(22) Filed: Jun. 17, 2002

(65) Prior Publication Data

US 2002/0153287 A1 Oct. 24, 2002

Related U.S. Application Data

(63) Continuation of application No. 09/334,404, filed on Jun. 16, 1999, now Pat. No. 6,431,366.

(51) Int. Cl.[7] ..... B07B 1/28

(52) U.S. Cl. ..... 209/311; 209/314; 209/315; 209/316; 209/317; 209/319; 209/405

(58) Field of Search ..... 209/243, 254, 209/255, 259, 264, 311, 314–317, 319, 353, 354, 405, 408, 409, 412

(56) References Cited

U.S. PATENT DOCUMENTS

| | | | | | |
|---|---|---|---|---|---|
| 790,572 | A | * | 5/1905 | Hickmsn | 209/355 |
| 821,874 | A | * | 5/1906 | Kirksey | 209/314 |
| 2,576,794 | A | * | 11/1951 | Hilscher et al. | 209/405 |
| 2,784,842 | A | * | 3/1957 | Cover | 209/254 |
| 3,232,431 | A | * | 2/1966 | Musschoot et al. | 209/243 |
| 3,241,671 | A | * | 3/1966 | Brauchla | 209/243 |
| 3,439,800 | A | * | 4/1969 | Tonjes | 209/3 |
| 3,642,133 | A | * | 2/1972 | Venanzetti | 209/314 |
| 3,680,697 | A | * | 8/1972 | Hubach | 209/240 |
| 3,688,902 | A | * | 9/1972 | Hubach | 209/240 |
| 4,065,382 | A | * | 12/1977 | Derrick, Jr. | 209/313 |
| 4,234,416 | A | * | 11/1980 | Lower et al. | 209/247 |
| 4,572,782 | A | * | 2/1986 | Smith et al. | 209/236 |
| 4,576,713 | A | * | 3/1986 | Melin | 209/254 |
| 5,273,164 | A | * | 12/1993 | Lyon | 209/315 |
| 5,322,170 | A | * | 6/1994 | Hadden | 209/314 |
| 5,337,901 | A | * | 8/1994 | Skaer | 209/314 X |
| 5,538,139 | A | * | 7/1996 | Keller | 209/382 |
| 5,749,471 | A | * | 5/1998 | Andersson | 209/315 X |
| 6,142,308 | A | * | 11/2000 | Ghosh et al. | 209/311 X |
| 6,431,366 | B2 | * | 8/2002 | Fallon | 209/311 |
| 6,540,089 | B2 | * | 4/2003 | Brock et al. | 209/316 |

FOREIGN PATENT DOCUMENTS

| | | | | |
|---|---|---|---|---|
| DE | 3601671 | * | 7/1987 | 209/314 |
| SU | 1080883 | * | 3/1984 | 209/314 |

* cited by examiner

*Primary Examiner*—Donald P. Walsh
*Assistant Examiner*—Matthew J. Kohner
(74) *Attorney, Agent, or Firm*—Conley Rose, P.C.

(57) ABSTRACT

A vibratory screening machine including an outer frame, an inner frame resiliently mounted on the outer frame, a plurality of screening units mounted in stacked and staggered relationship on the inner frame, each of the screening units including a screen-supporting surface and a chamber underlying the screen-supporting surface and an outlet duct in communication with the chamber, an undersize trough underlying the plurality of stacked and staggered screening units, a plurality of inlet ducts in the undersize trough with each of the inlet conduits in communication with one of the outlet conduits, and an oversize trough underlying the undersize trough and the stacked and staggered screening units.

26 Claims, 9 Drawing Sheets

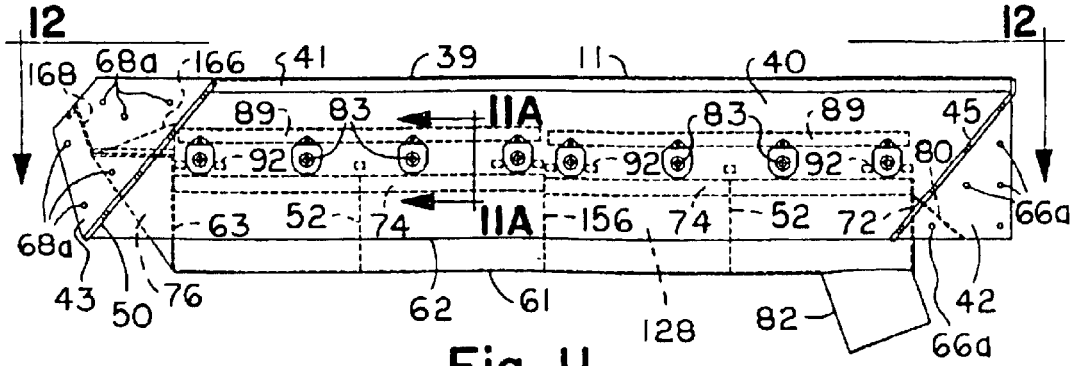
Fig. 11.
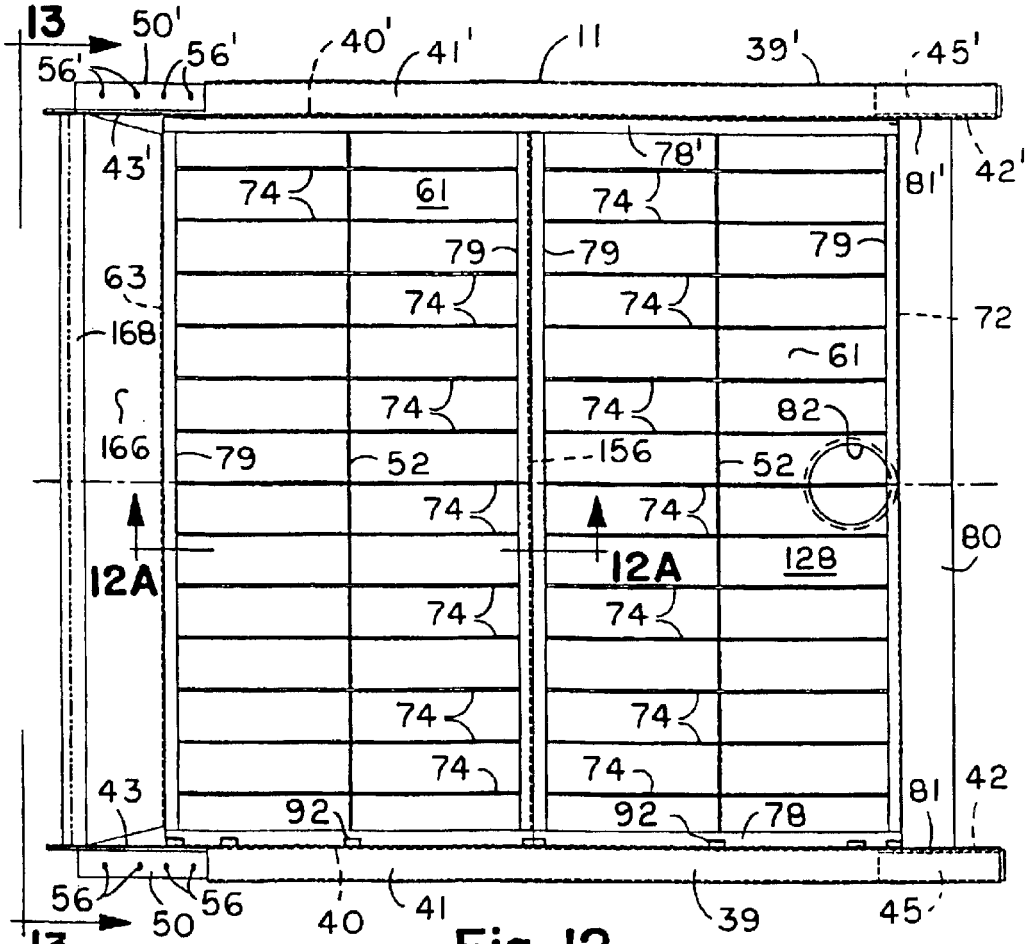
Fig. 12.
Fig. 13.
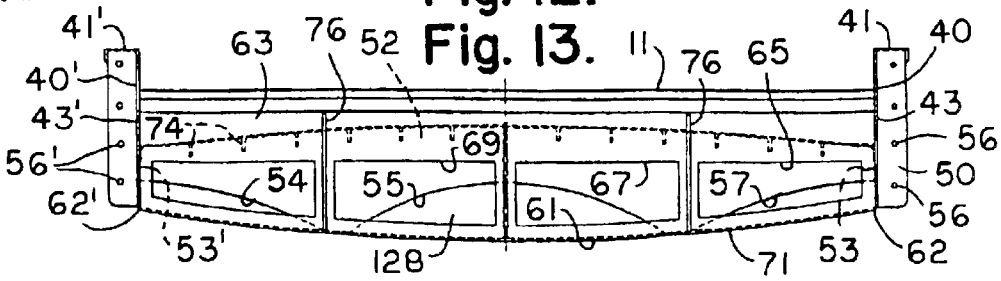

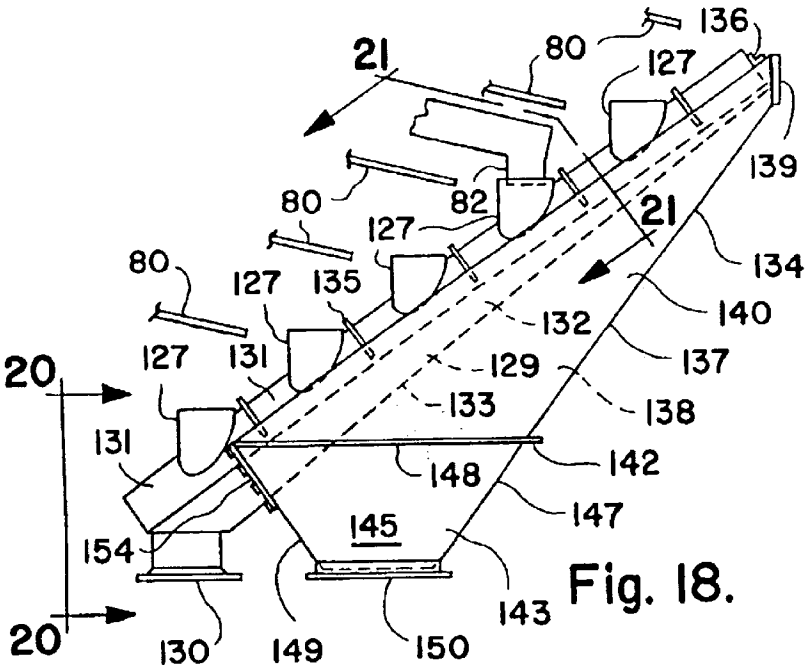
Fig. 18.
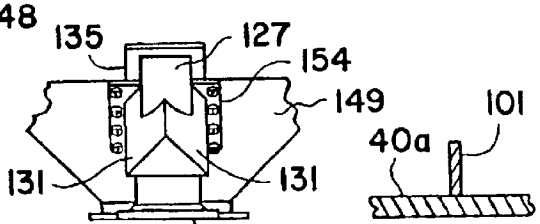
Fig. 15A.
Fig. 20.
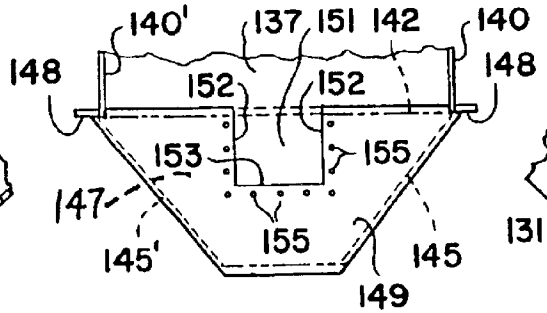
Fig. 19.
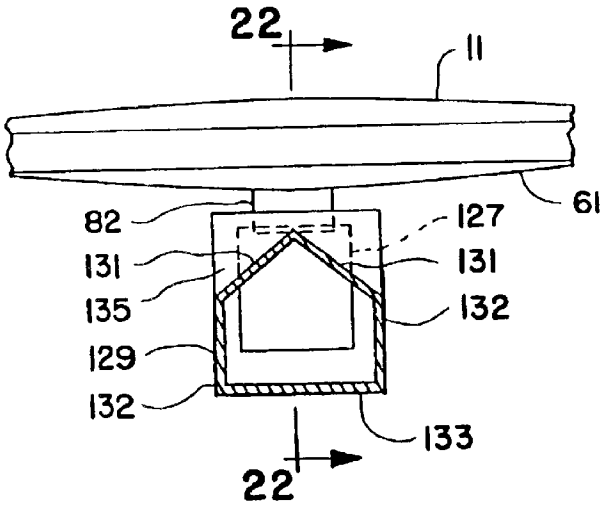
Fig. 21.
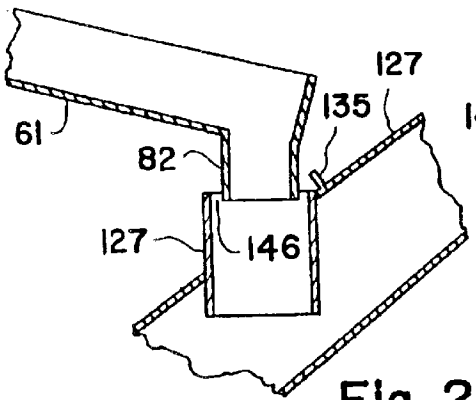
Fig. 22.

VIBRATORY SCREENING MACHINE WITH STACKED AND STAGGERED SCREENING UNITS

CROSS-REFERENCE TO RELATED APPLICATIONS

This application is a continuation of application Ser. No. 09/334,404 filed Jun. 16, 1999, now U.S. Pat. No. 6,431,366.

STATEMENT REGARDING FEDERALLY SPONSORED RESEARCH OR DEVELOPMENT

Not Applicable

BACKGROUND OF THE INVENTION

The present invention relates to a vibratory screening machine having a plurality of stacked and staggered screening units thereon.

By way of background, in certain situations floor space is at a premium and therefore it is advantageous to have a stacked and staggered screening machine which provides a large amount of screening area on a relatively small floor area. It is with a machine of this type that the present invention is concerned.

BRIEF SUMMARY OF THE INVENTION

It is one object of the present invention to provide an improved vibratory screening machine having a plurality of screening units mounted thereon in an extremely efficient stacked and staggered relationship.

It is another object of the present invention to provide a vibratory screening machine having a plurality of modular screening units mounted thereon in stacked and staggered relationship and wherein each of the modular units can be removed from and mounted on the machine without effecting the other modular units. Other objects and attendant advantages of the present invention will readily be perceived hereafter.

The present invention relates to a vibratory screening machine comprising an outer frame, an inner frame mounted on said outer frame, a plurality of screening units mounted in stacked and staggered relationship on said inner frame, each of said screening units including a screen-supporting surface and a chamber underlying said screen-supporting surface and an outlet duct in communication with said chamber, an undersize trough underlying said plurality of stacked and staggered screening units, a plurality of inlet ducts in said undersize trough with each of said inlet conduits in communication with one of said outlet conduits, and an oversize trough underlying said undersize trough and said stacked and staggered screening units.

The present invention also relates to a vibratory screening machine comprising an outer frame, an inner frame mounted on said outer frame, and a plurality of modular screening units individually removable and remountable in stacked and staggered relationship on said inner frame.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 11 is a side elevational view of a vibratory screening unit including the mounting structure on the ends thereof and its pan;

FIG. 12 is a plan view of the vibratory screening unit taken substantially in the direction of arrows 12—12 of FIG. 11;

FIG. 13 is an end elevational view of the vibratory screening unit taken substantially in the direction of arrows 13—13 of FIG. 12;

FIG. 15A is a fragmentary cross sectional view taken substantially along line 15A—15A of FIG. 15;

FIG. 18 is a fragmentary side elevational view showing the undersize hopper mounted within the oversize hopper and also showing schematically the ends of the screening units with respect to the undersize hopper and also showing the relationship between the outlet pipes of the pans of the screening units relative to the inlet pipes of the undersize hopper;

FIG. 19 is a side elevational view of the end plate of the oversize hopper and a fragmentary view of the sides and bottom of the oversize hopper;

FIG. 20 is a fragmentary end elevational view taken substantially in the direction of arrows 20—20 of FIG. 18;

FIG. 21 is a fragmentary cross sectional view taken substantially along line 21—21 of FIG. 18;

FIG. 22 is an enlarged fragmentary cross sectional view taken substantially along line 22—22 of FIG. 21;

DETAILED DESCRIPTION OF THE INVENTION

Figure 1:
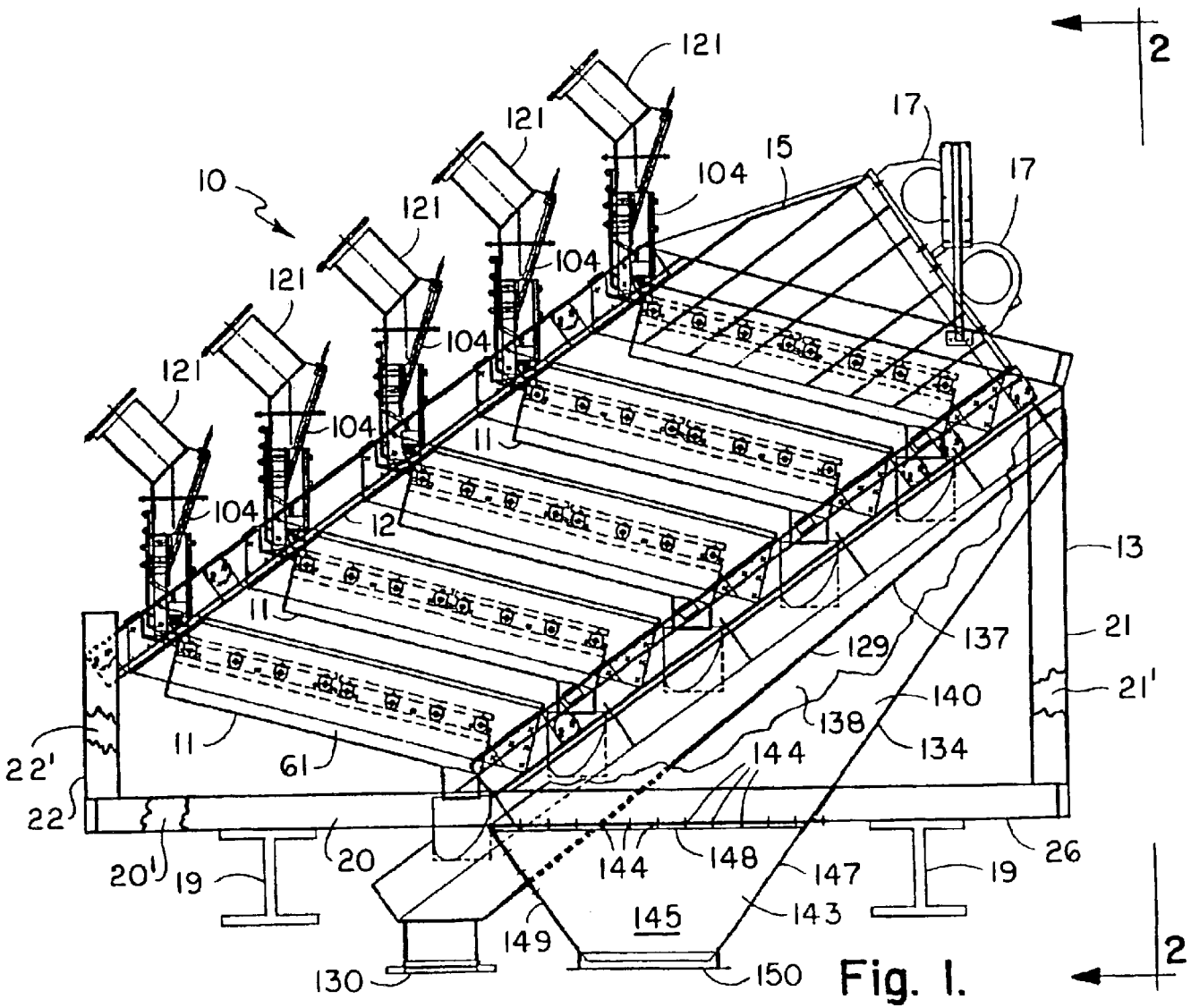
FIG. 1 is a side elevational view of the stacked-staggered vibratory screening machine of the present invention with the vibratory screening portion resiliently mounted on an outer fixed frame and with the oversize hopper secured to the outer frame and partially broken away to permit viewing of the undersize hopper located partially within the oversize hopper.

Summarizing briefly in advance, the stacked-staggered vibratory screening machine 10 of the present invention includes a plurality of modular screening units 11 mounted in stacked-staggered relationship on an inner frame 12 which in turn is resiliently mounted on an outer frame 13.

Also mounted on the inner frame 12 is a top screening unit 15 which also mounts a plurality of vibratory motors 17. The screening units 11 are all identical and each of these screening units can be removed and replaced without disassembling the inner frame 12 on which they are mounted. Also, the stacked-staggered relationship of the screening units 11 permits the entire vibratory screening machine 10 to occupy less floor space than if the screening units were not stacked. In operation the vibratory screening unit 10 is mounted on a suitable framework which is schematically designated in FIG. 1 by a plurality of I-beams 19 which extend crosswise of and to which outer frame 13 is bolted. It will be appreciated that the outer frame 13 may be secured to any suitable framework or base in any suitable manner.

Figure 4:
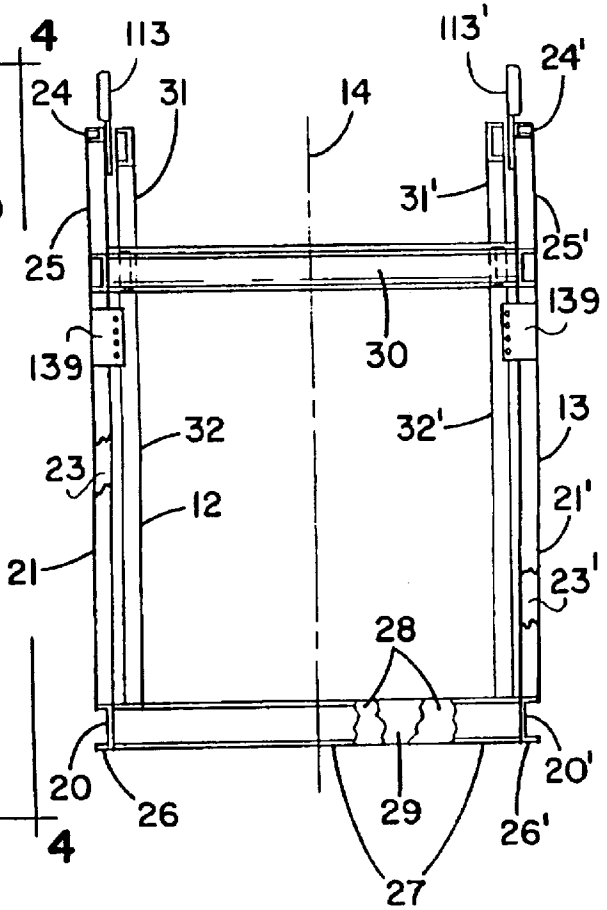
FIG. 4 is an end elevational view of the outer and inner frames taken substantially in the direction of arrows 4—4 of FIG. 3.

Both frames 12 and 13 and other parts of machine 10 have mirror-image counterparts on opposite sides of centerline 14 (FIG. 4). Therefore, parts on one side of frames 12 and 13 will be designated by unprimed numerals and mirror image counterparts will be designated by like primed numerals. However, in certain instances where only one of the mirror image counterparts is described by the use of an unprimed or primed numeral, it will be appreciated that the corresponding mirror-image counterpart may only be designated by a primed or unprimed numeral, respectively, without an accompanying description of that part.

Figure 3:
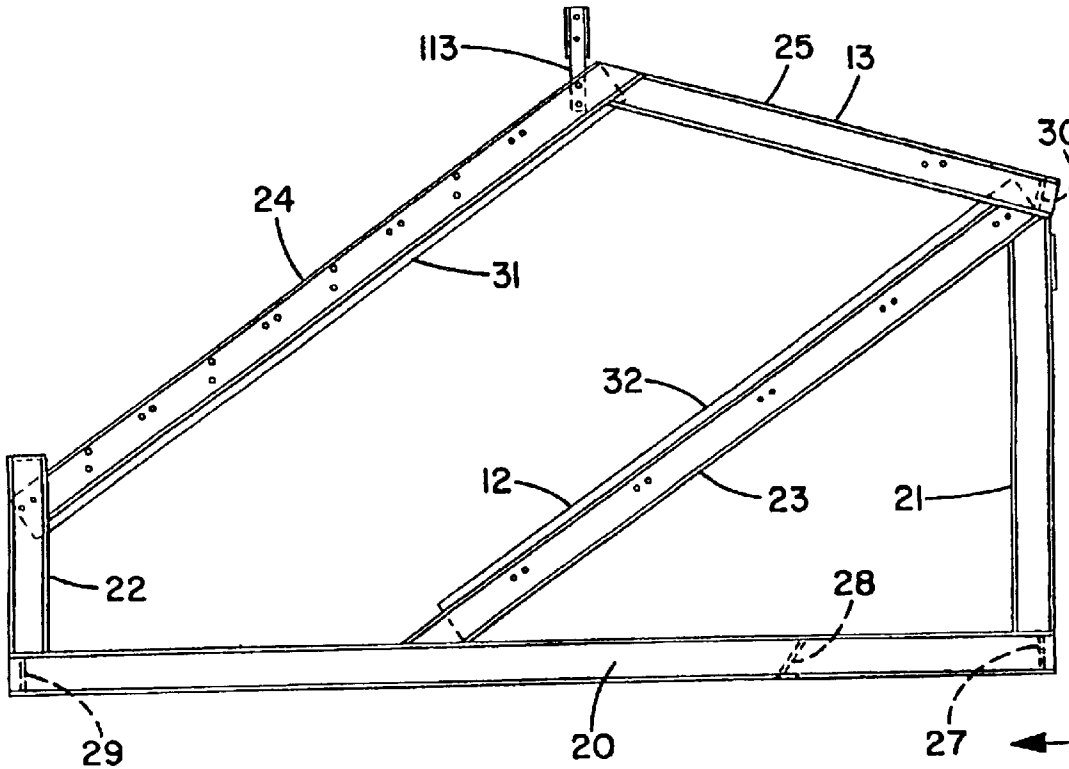
FIG. 3 is a side elevational view showing only the outer and inner frames.

The outer frame 13 includes two elongated base mirror-image counterpart channels 20 and 20' (FIGS. 1, 3 and 4). Upstanding channels 21 and 22 and their mirror-image counterparts 21' and 22', respectively, have their lower ends welded to channels 20 and 20', respectively. Lower inclined channel 23 and its mirror image counterpart 23' have their lower ends welded to channels 20 and 20', respectively, and their upper ends welded to the upper ends of channels 21 and 21', respectively. Upper inclined channels 24 and 24' have their lower ends welded to channels 22 and 22', respectively, and their upper ends welded to channels 25 and 25', respectively, which have their lower ends welded to the upper ends of channels 23 and 23'. Channel 27 has its opposite ends welded between base channels 20 and 20' underneath vertical channels 21 and 21', respectively. A like channel 29 has its opposite ends welded to base channels 20 and 20' below vertical channels 22 and 22', respectively. A channel 30 has its opposite ends welded to the lower ends of channels 25 and 25'. A strut 28 has its opposite ends welded to channels 20 and 20'.

Figure 10:
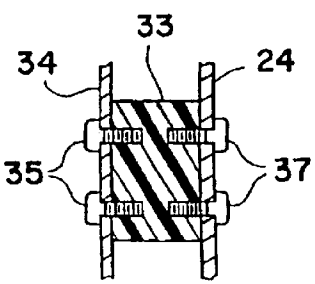
FIG. 10 is a fragmentary cross sectional view taken substantially along line 10—10 of FIG. 9.
Figure 9:
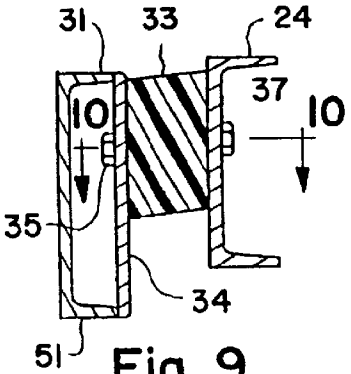
FIG. 9 is a cross sectional view taken substantially along line 9—9 of FIG. 5 and showing a cylindrical resilient block mounted between the outer upper channel and the upper inner channel which supports the screening units.
Figures 5, 6, 7, 8:
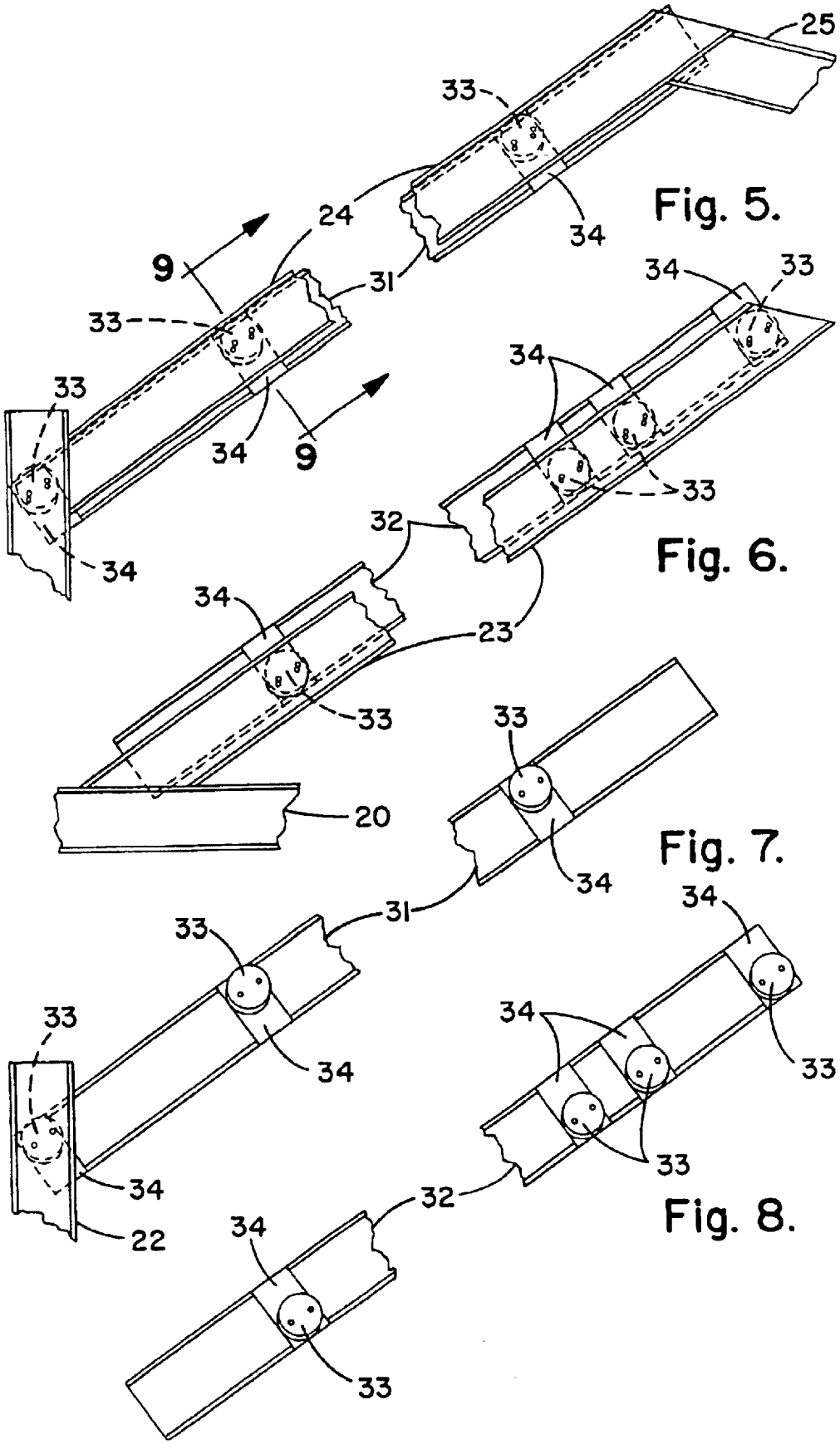
FIG. 5 is an enlarged fragmentary side elevational view of the upper outside support channel of the outer frame mounting the upper inner channel which mounts the screening units.
FIG. 6 is an enlarged fragmentary side elevational view of the lower outer channel of the fixed frame mounting the lower inner channel which supports the screening units.
FIG. 7 is an enlarged fragmentary side elevational view of the upper inner channel which mounts the screening units.
FIG. 8 is an enlarged fragmentary side elevational view of the lower inner channel which mounts the screening units.
Figure 23:
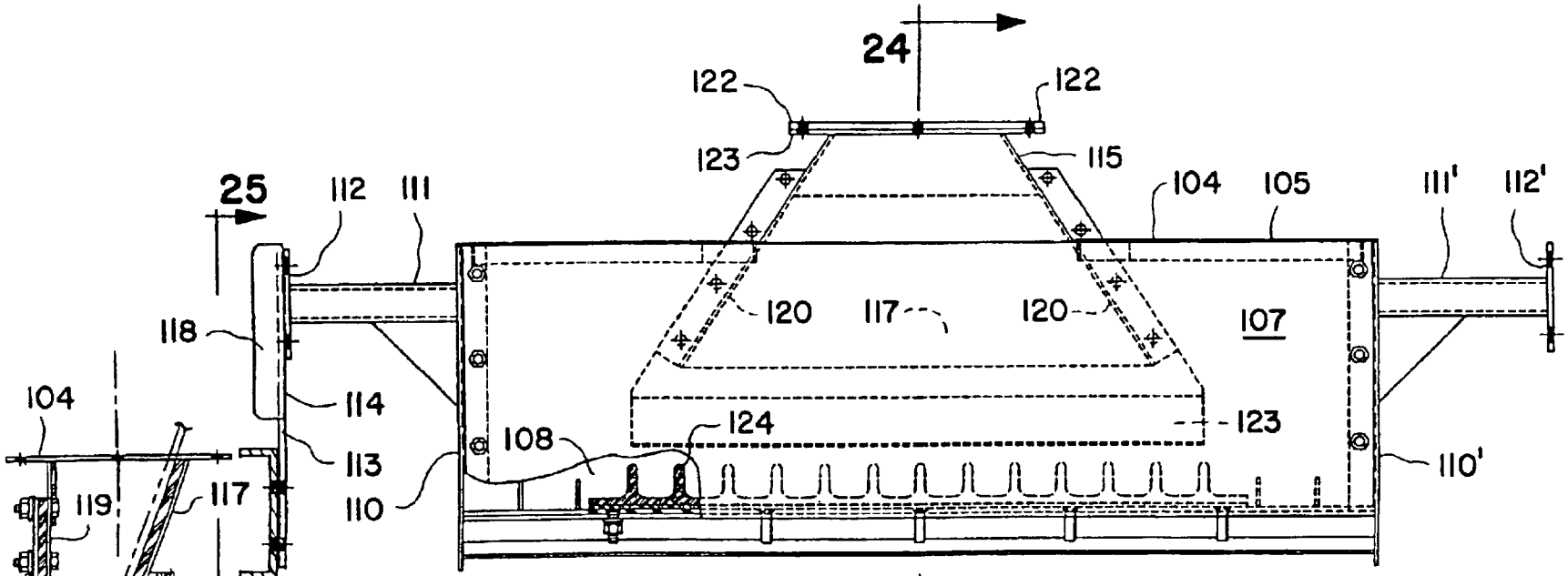
FIG. 23 is a side elevational view, partially broken away, of one of the feed distribution boxes for the vibratory screening units.

The inner frame 12, which mounts modular screening units 11 and top screening and motor unit 15, is resiliently mounted on outer frame 13. Inner frame 12 includes mirror-image counterpart upper channels 31 and 31' and lower mirror-image counterpart channels 32 and 32' (FIGS. 3 and 4). The resilient mounting is effected by bolting the inner channels 31 and 32 to resilient cylindrical blocks 33 (FIGS. 5–10) which are also bolted to outer frame channels 24 and 23, respectively. Also inner channels 31' and 32' are bolted to cylindrical blocks 33 which are bolted to outer channels 24' and 23', respectively, in the same manner, but in mirror image relationship. In the foregoing respect, plates 34 (FIGS. 5–10) have their opposite ends welded across the legs of the inner channels 31 and 32 with which they are associated. Plates 34 are also welded to inner channels 31' and 32' in a corresponding manner. A pair of bolts 35 fastens each block 33 to an associated plate 34 (FIGS. 9 and 10) and a pair of bolts 37 fastens each block 33 to the web of an associated channel, such as 24. Also, the lowermost resilient block 33 is fastened in a like manner between upstanding channel 22 and channel 31 (FIGS. 5 and 7), and a like connection is made between upstanding channel 22' and channel 31'.

Figure 14:
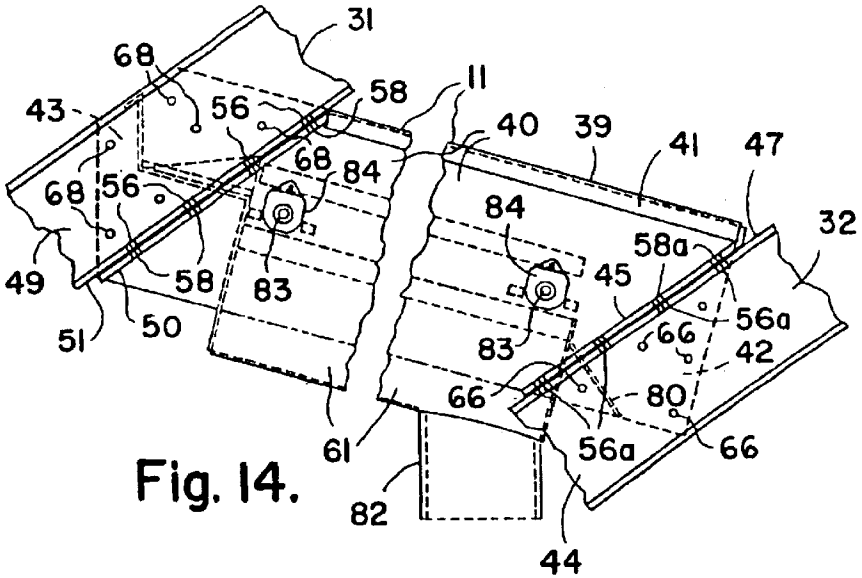
FIG. 14 is a enlarged fragmentary side elevational view of portions of FIG. 11 and including the lower and upper inner channels on which it is mounted.
Figure 11A:
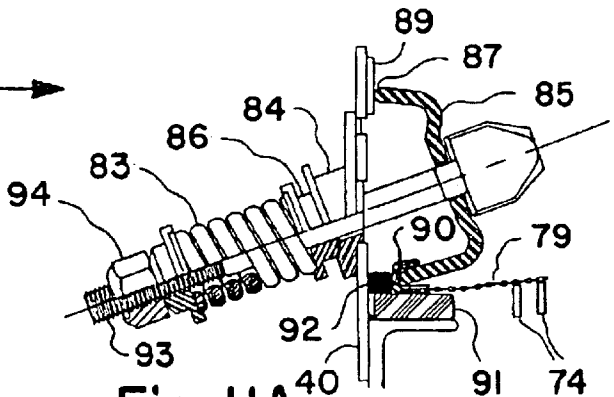
FIG. 11A is an enlarged fragmentary cross sectional partially schematic view taken substantially along line 11A—11A of FIG. 11 and showing the vibratory screen mounting structure.
Figure 25:
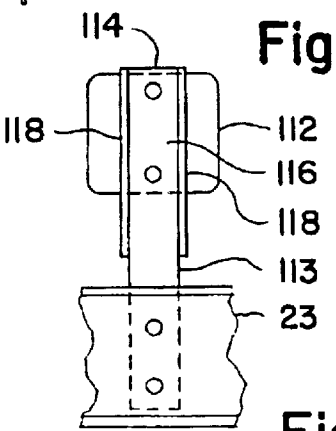
FIG. 25 is a view taken substantially in the direction of arrows 25—25 of FIG. 23 showing a feed distribution box mounting bracket.
Figure 24:
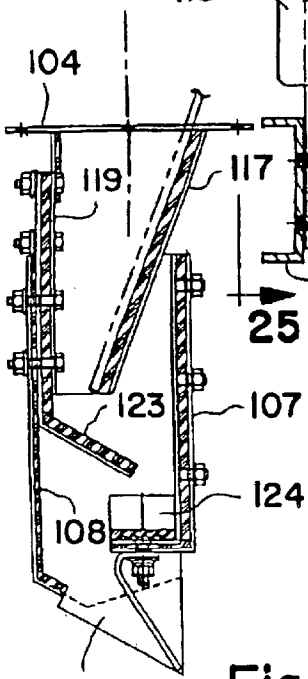
FIG. 24 is a cross sectional view taken substantially along line 24—24 of FIG. 23.
Figure 13A:
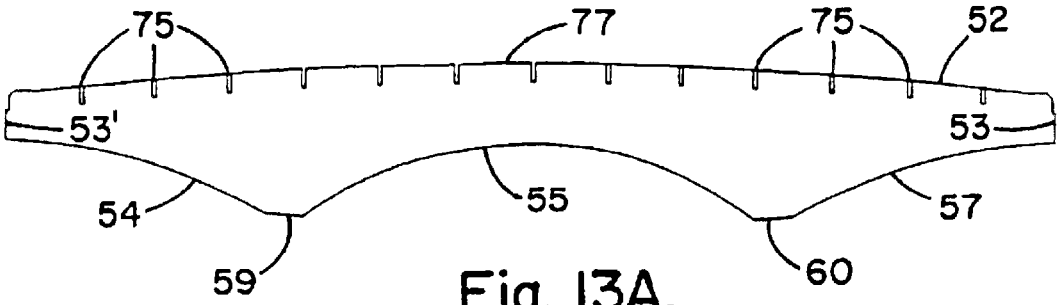
FIG. 13A is a side elevational view of one of the bulkheads shown in FIGS. 11–13.
Figure 13B:
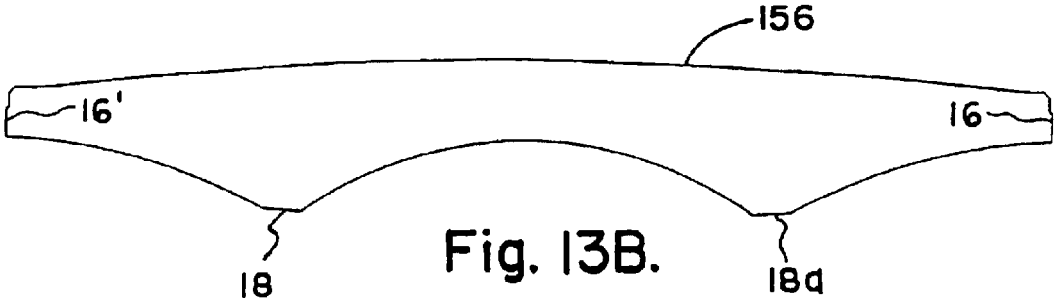
FIG. 13B is a side elevational view of another bulkhead.
Figure 13C:
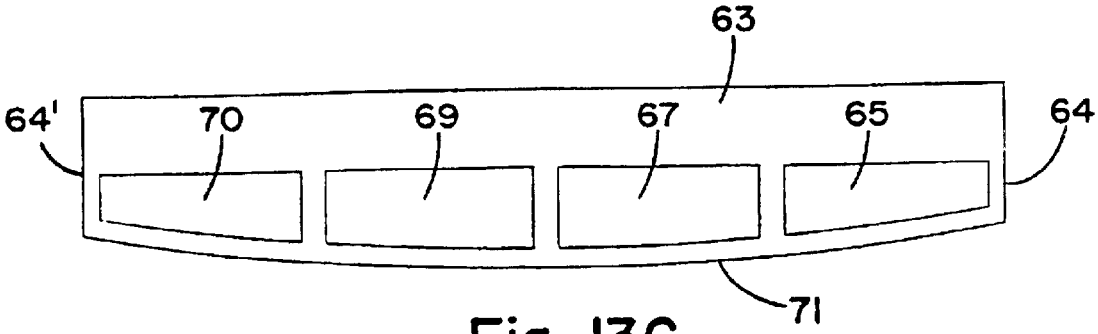
FIG. 13C is a side elevational view of the rear end plate of the screening unit.
Figure 13D:
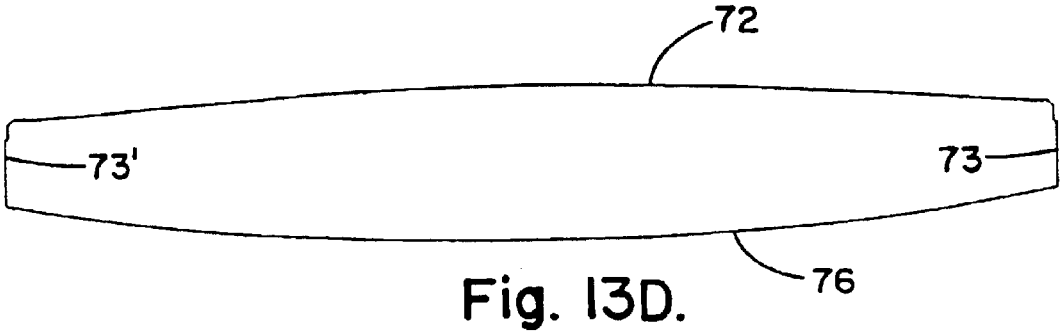
FIG. 13D is a side elevational view of the front end plate of the screening unit.

Each modular screening unit 11 has a pair of substantially mirror-image sides 39 and 39' (FIGS. 12 and 13). Side 39 has its opposite ends rigidly secured between inner frame members 31 and 32 (FIG. 14), and side 39' is secured in a mirror-image relationship to inner channels 31' and 32'. Each modular screening unit 11 includes a side plate 40 which has a flange 41 formed at its upper end. Plate 40 includes a triangular portion 42 at one end and a trapezoidal portion 43 at its opposite end. The triangular portion 42 is placed in contiguous relationship with the web 44 of channel 32 (FIG. 14), and flange 45 is located in contiguous relationship to leg 47 of channel 32. Trapezoidal end 43 is located in contiguous relationship to web 49 of channel 31 and flange 50 is positioned in contiguous relationship to leg 51 of channel 31. Bolts (not shown) pass through the holes 56 in channel leg 51 and the holes 58 in flange 50. Also bolts (not shown) pass between holes **56*a* in channel leg 47 and holes 58*a* in flange 45. Bolts (not shown) also pass through holes 66 (FIG. 14) in channel 32 and holes 66*a* (FIG. 11) in triangular end 42, and bolts (not shown) also pass through holes 68 (FIG. 14) in channel 31 and holes 68*a* (FIG. 11) of trapezoidal end 43 to further secure each modular unit between upper inner upper frame channel 31 and inner lower frame channel 32. The opposite side 39' of each screening unit 11 is secured between upper and lower inner frame channels 31' and 32'** in a corresponding manner.

Figure 12A:
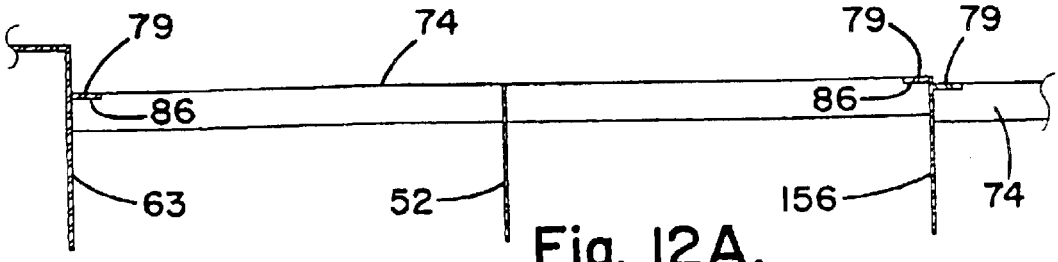
FIG. 12A is an enlarged fragmentary cross sectional view taken substantially along line 12A—12A of FIG. 12.

Each modular screening unit 11 includes the following structure. A plurality of bulkheads or ribs 52 and 156 (FIGS. 11–13, 13A and 13B) have their opposite ends welded to side plates 40 and 40'. The edges 53 and 53' of bulkheads 52 are welded to side plates 40 and 40', and the edges 16 and 16' of bulkhead 156 are welded to these side plates in an analogous manner. The lower edge of each bulkhead 52 is scalloped at 54, 55 and 57 and its lowermost edges 59 and 60 (FIG. 13A) are welded to a concave pan 61, the opposite side edges of which are welded to plates 40 and 40' along lines 62 and 62' (FIG. 13). The lower edges 18 and 18*a* of bulkhead 156 are welded to concave pan 61. A rear bulkhead or wall 63 (FIGS. 13 and 13C) has its opposite ends 64 and 64' welded to side plates 40 and 40', respectively. A plurality of openings 65, 67, 69 and 70 are located in rear wall 63. The bottom edge 71 of end wall 63 is welded along pan 61. A front wall 72 (FIG. 13D), which is the same shape as rear wall 63, without openings therein, has its opposite edges 73 and 73' welded to side plates 40 and 40', respectively, and its bottom edge 76 is welded to the edge of pan 61. A plurality of stringers 74 (FIGS. 12 and 12A) are located in notches 75 (FIG. 13A) in the top edges 77 of bulkheads 52, and the screen 79 (FIG. 11A) is supported on stringers 74. Bulkhead 156 (FIG. 13B) has the same outer shape as bulkhead 52 but it does not have slots for receiving stringers 74, and the ends of stringers 74 adjacent thereto (FIG. 12A) are welded to its opposite sides. At this point it is to be noted that screen 79 is shown only schematically. It can be any type of screen whatsoever which will fit onto the modular screening unit 11. Such screens may include, without limitation, screens such as shown in U.S. Pat. Nos. 4,575,421 and 5,417,859, both of which are incorporated herein by reference, or any other type of screen. Metal strips 79, 78 and 78' (FIG. 12) extend across the tops of stringers 74 and are received in notched-out portions 86 in the tops of the stringers (FIG. 12A). An elongated strip-like plate 80 has its opposite ends welded to triangular ends 42 and 42' of side plates 40 and 40', respectively, at 81 and 81', respectively (FIG. 12). End wall 63 has portions 166 and 168 (FIGS. 11 and 12) formed integrally therewith, the opposite edges of which are welded to members 43 and 43'. A plurality of gussets 76 (FIGS. 11 and 13) are located on the outside of plate 63 and their edges are welded to plate 63 and to portion 166. A pipe 82 leads from pan 61.

A plurality of screen-tensioners 83 (FIGS. 11 and 11A) are mounted on each side plate 40 and 40'. In this respect, a plurality of wedge members 84 are welded to side plates 40 and 40', and tensioners 83 have portions 86 which bear against these wedge members, as is well known in the art. Side 40 mounts eight tensioners 83, and side 40' mounts eight tensioners 83 in mirror image relationship. Four tensioners 83 are associated with a channel 85 (FIG. 11A) and thus there are two channels 85 associated with plate 40. There are also two channels 85 associated with the eight tensioners on side 40'. The upper edge of each channel 85 bears against a wear plate 89. The lower edge of each channel 85 engages channel 90 which is on the edge of screen 79, as is well known in the art. Channel 90 rests on support 91 and it bears against a plurality of spacers 92. As is well known in the art, screen channel 90 is pulled up against spacers 92, which are only on side 40, and thereafter the tensioners 83 on side 40' tension the screen 79. The spacers prevent screen channel 90 from engaging side 40. The tensioner 83 pulls rod 93 to the left in FIG. 11A when nut 94 is tightened to thereby move channel 85 to the left. The foregoing structure is well known and conventional in the art.

As noted briefly above, each of the screening units 11 is modular, that is, it can be removed from the inner frame 12 without disturbing the other modular screening units 11. In this respect, all that is required is to remove the bolts which secure flanges 42 and 43 (FIG. 14) and their mirror-image counterparts 42' and 43' (FIG. 12), respectively, from their respective frame members 31, 32, 31' and 32', and thereafter pivot the modular screening unit 11 in a counter-clockwise direction in FIG. 1 to provide the necessary clearance relative to inner frame 12 to permit the modular screening unit 11 to be withdrawn laterally from inner frame 12.

Figure 15:
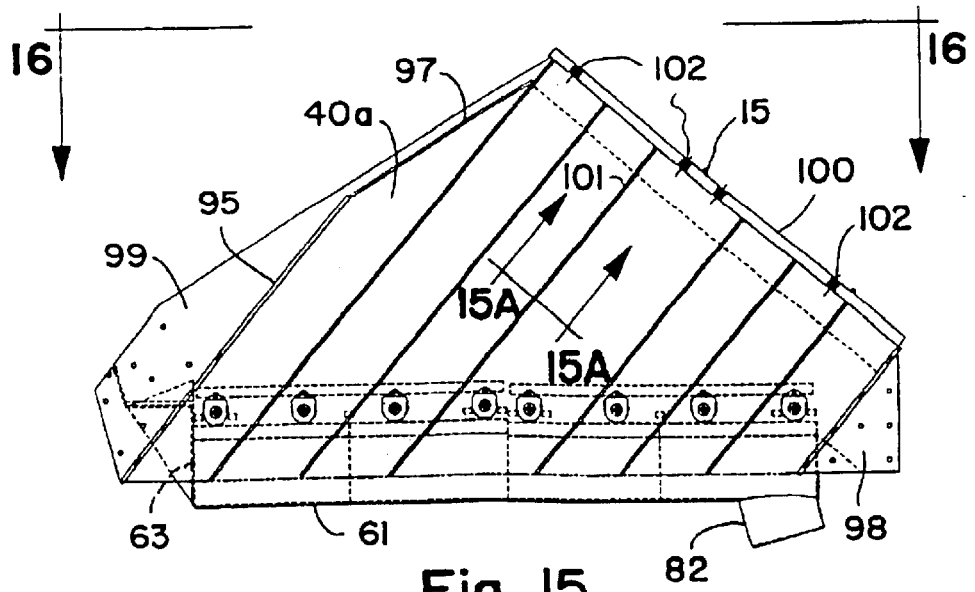
FIG. 15 is a side elevational view of the top vibratory screening unit which also mounts the vibratory screening motors.
Figure 16:
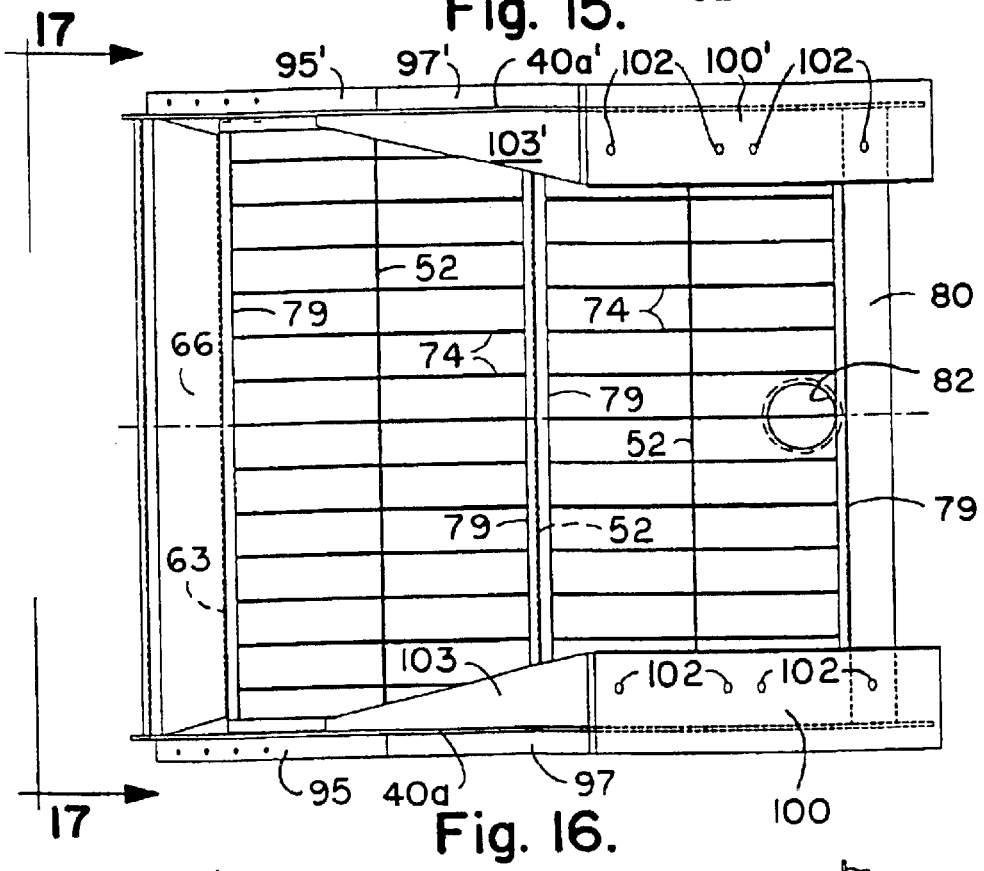
FIG. 16 is a plan view taken substantially in the direction of arrows 16—16 of FIG. 15.
Figure 17:
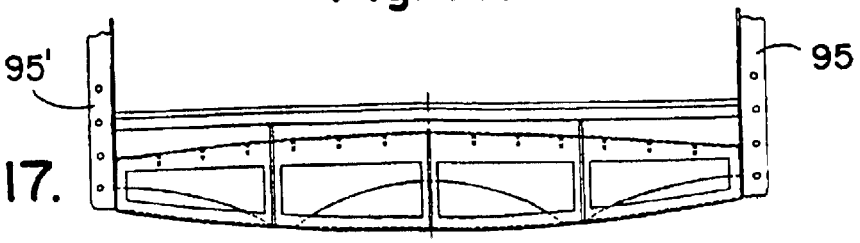
FIG. 17 is a fragmentary end elevational view taken substantially in the direction of arrows 17—17 of FIG. 16.

In FIGS. 15–17 the combined screening and vibratory motor mounting unit 15 is disclosed. The screening portion of the combined screening and vibratory mounting unit 15 is identical to the screening unit 11 described above relative to FIGS. 11–14 except that the side plates 40 and 40' have been replaced by mirror image polygonal side plates 40*a* and 40*a*'. All of the structure described above in FIGS. 11–14 is mounted relative to side plates 40*a* and 40*a*' and therefore will not be described further relative to FIGS. 15–17. Side plate 40*a* will be described hereafter utilizing unprimed numerals and corresponding mirror-image counterparts of side plate 40*a*' will merely be designated by primed numerals. Parts in FIGS. 15–17 which are identical to parts of FIGS. 11–14 will be designated by identical numerals. However, not all numerals which appear on FIGS. 11–14 will be placed on FIGS. 15–17, and it will be understood that unless stated otherwise the parts of FIGS. 11–14 and the parts of FIGS. 15–17 are identical. One difference of unit 15 is that the flange 95 is much longer than corresponding flange 50 of FIG. 12, and it merges into a flange 97. Also, the end portion 99 of plate 40*a* is larger than portion 43 of plate 40. However, end portion 99 has similar mounting holes which are secured by bolts to channel 31. Also, end portion 98 of plate 40*a* is identical to part 42 of plate 40 for mounting on channel 32. Plates 100 and 100' are welded to the tops of plates 40*a* and 40*a*', respectively, and a plurality of reinforcing ribs such as rib 101 but of different lengths (FIGS. 15 and 15*a*) are welded to plate 40*a* and extend parallel to each other with their upper ends being welded to the underside of plate 100. Mirror-image structure (not shown) is associated with plate 40*a*'. Plates 100 and 100' have apertures 102 therein which receive bolts which pass through bases (not shown) of electric vibratory motors 17 to thereby secure motors 17 to plates 100 and 100'. Gusset 103 has one edge welded to plate 100 and another edge welded to plate 40*a*.

A liquid feed arrangement 104 is shown in FIGS. 1 and 23–25. This arrangement includes a feed distribution box 105 having a front wall 107, a rear wall 108 and a pair of side walls 110 and 110'. The feed distribution box has tubular members 111 and 111' extending from side walls 110 and 110', respectively, which terminate at plates 112 and 112', respectively. A bracket 113 has its lower portion bolted to outer frame channel 23 and plate 112 is bolted to the upper portion 114 of bracket 113. Upper portion 114 includes a central planar portion 116 bounded by flanges 118. A mirror-image counterpart bracket (not shown) is bolted to outer frame member 23' and plate 112' is bolted to that bracket in mirror-image relationship to the arrangement shown in FIG. 23.

A nozzle 115 includes a front wall 117, a rear wall 119 and a pair of side walls 120. Rear wall 119 is bolted to rear wall 108 by a plurality of bolts (not numbered). A conduit arrangement 121 (FIGS. 1 and 2) has a lower flange 122 which is bolted to flange 123 of nozzle 115. Liquid which enters nozzle 115 splashes against plate 117 and thereafter splashes against flange 123 which directs it to comb-like member 124 which channels the liquid through opening 125. All parts of the feed arrangement are part of the prior art except for the tubular members 111 and 111' and the brackets such as 113 which attach them to fixed outer frame 13.

As is understood, material to be screened contains undersize particles which pass through screen 79, and it also contains oversize particles which pass over the screen and drop off the plate 80 of the screen unit 11 (FIGS. 12 and 18). The plates 80 of the screen units 11 are shown schematically in FIG. 18. The undersize material which passes through each screen 79 is deposited in the chamber 128 (FIGS. 11 and 13) of each screening unit 11 which is above pan 61, and such material passes through each pipe or duct 82 and is received in pipes or ducts 127 (FIG. 18) of undersize hopper or trough 129 and is conveyed thereby to outlet port 130. Trough 129 includes pipes 127 which are positioned in the top of the trough which consists of upper inclined side walls 131 (FIG. 21), and the exit portions of pipes 82 are positioned in the inlet portions of pipes 127 with radial clearances 146 (FIG. 22) therebetween. These radial clearances are necessary because pipes 82 vibrate because they are mounted on inner frame 12, whereas pipes 127 are stationary because they are mounted on outer frame 13. The undersize trough also includes lower side walls 132 and a bottom wall 133 (FIG. 21). An angle 136 connects the upper end of trough 129 to the sides 140 of oversize trough or hopper 134.

Figure 2:
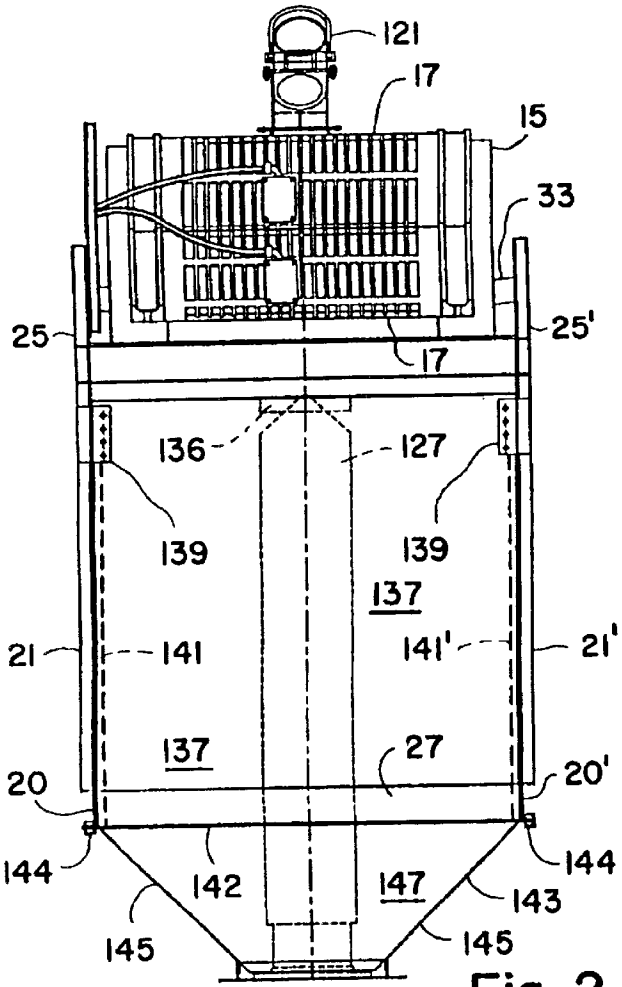
FIG. 2 is an end elevational view taken substantially in the direction of arrows 2—2 of FIG. 1.

The oversize particles which pass off of the ends of plates 80 of screen units 11 do not pass into pipes 127, but merely fall onto inclined sides 131 of undersize trough 129. A plurality of deflector plates 135 extend upwardly from inclined walls 131 of undersize trough 129 so that the liquid which passes off of the ends of plates 80 will not enter pipes 127 but will merely pass around undersize trough 129 and drop into the chamber 138 (FIGS. 1 and 18) of oversize trough or hopper 134. In this respect, oversize trough 134 includes a bottom plate 137 (FIGS. 1, 2 and 18) which extends for the entire width between channels 21 and 21' of the outer frame 13 and it is secured to these channels by brackets 139. Oversize trough 134 also includes side walls 140 and 140' which have their lower edges welded to the outer edges of plate 137 at 141 and 141' (FIG. 2). Oversize trough 134 is open between the tops of side plates 140 and 140', as can be visualized from FIGS. 18 and 19. The lower edges of bottom plate 137 and side plates 140 are welded to flanges 148 and 142 of bottom section 143 of oversize trough 129, and flanges 148 are bolted at 144 (FIGS. 1 and 2) to the lower legs 26 and 26' (FIGS. 1 and 4) of outer frame channels 20 and 20', respectively. The bottom section 143 of oversize trough 134 includes two side walls 145 and 145' (FIGS. 18 and 19), a rear wall 147 and a front wall 149 (FIGS. 1, 2, 18, 19 and 20). The outlet port 150 of oversize hopper 134 is positioned at the convergence of walls 145, 145', 147 and 149.

The lower end of undersize trough 129 is secured to front plate 149 of oversize hopper 134 in the following manner. The lower end of undersize hopper 129 fits into opening 151 (FIG. 19) of front plate 149 with the sides 132 of undersize hopper 129 in contiguous relationship to sides 152 of opening 151 and with bottom wall 133 in contiguous relationship to side 153 of opening 151. A flange 154 (FIGS. 18 and 20) which extends outwardly from side walls 132 and bottom wall 133 of undersize hopper 129 is bolted to the borders of opening 151 by a plurality of bolts (not numbered) which extend through the holes 155 in front plate 149.

While preferred embodiments of the present invention have been disclosed, it will be appreciated that it is not limited thereto but may be otherwise embodied within the scope of the following claims.

What is claimed is:

1. A vibratory screening machine comprising an outer frame, an inner frame mounted on said outer frame, a plurality of screening units mounted in stacked and staggered overlying relationship on said inner frame, each of said screening units including a screen-supporting surface and an undersize-material receiving chamber underlying said screen-supporting surface and an outlet duct in communication with said chamber, an undersize-material receiving trough underlying said plurality of stacked and staggered screening units, a plurality of inlet ducts in said undersize-material receiving trough with each of said inlet ducts in communication with one of said outlet ducts, and an oversize-material receiving trough underlying said undersize-material receiving trough and said stacked and staggered screening units.

2. A vibratory screening machine as set forth in claim 1 including resilient mountings between said outer frame and said inner frame, and a vibratory motor mounted on said inner frame.

3. A vibratory screening machine as set forth in claim 2 including an entry portion on each of said inlet ducts, an exit portion on each of said outlet ducts within each of said inlet ducts, and a clearance between each of said exit portions and said entry portions.

4. A vibratory screening machine as set forth in claim 3 including a first outlet port in said undersize-material receiving trough, and a second outlet port in said oversize-material receiving trough.

5. A vibratory screening machine as set forth in claim 4 wherein each of said screening units is inclined downwardly toward said undersize-material receiving trough, and a screening unit lower end portion on certain of said screening units overlying said undersize trough between said inlet ducts of said undersize-material receiving trough.

6. A vibratory screening machine as set forth in claim 5 including deflector plates on said undersize-material receiving trough positioned between said inlet ducts.

7. A vibratory screening machine as set forth in claim 1 including a covered top on said undersize-material receiving trough, and said inlet ducts extending upwardly from said covered top.

8. A vibratory screening machine as set forth in claim 7 including resilient mountings between said outer frame and said inner frame, and a vibratory motor mounted on said inner frame.

9. A vibratory screening machine as set forth in claim 8 including an entry portion on each of said inlet ducts, an exit portion on each of said outlet ducts within each of said inlet ducts, and a clearance between each of said exit portions and said entry portions.

10. A vibratory screening machine as set forth in claim 9 including a first outlet port in said undersize-material receiving trough, and a second outlet port in said oversize-material receiving trough.

11. A vibratory screening machine as set forth in claim 10 wherein each of said screening units is inclined downwardly toward said undersize-material receiving trough, and a screening unit lower end portion on certain of said screening units overlying said undersize-material receiving trough between said inlet ducts of said undersize-material receiving trough.

12. A vibratory screening machine as set forth in claim 11 including deflector plates on said undersize-material receiving trough positioned between said inlet ducts.

13. A vibratory screening machine as set forth in claim 1 including an individual liquid feed distribution member associated with each of said screening units.

14. A vibratory screening machine comprising an outer frame, an inner frame mounted on said outer frame, a plurality of modular screening units each comprising a screen-supporting surface and an undersize-material receiving chamber underlying each screen-supporting surface individually removable and remountable in stacked and staggered overlying relationship on said inner frame, and resilient mountings between said inner frame and said outer frame.

15. A vibratory screening machine as set forth in claim 14 including a vibratory motor mounted on said inner frame.

16. A vibratory screening machine comprising an outer frame, an inner frame mounted on said outer frame, a plurality of modular screening units each comprising a screen-supporting surface and an undersize-material receiving chamber underlying each screen-supporting surface individually removable and remountable in stacked and staggered overlying relationship on said inner frame, and an undersize-material receiving trough extending for substantially the entire length of and underlying all of said modular screening units.

17. A vibratory screening machine as set forth in claim 16 including an oversize-material receiving trough underlying substantially said entire length undersize trough and said modular screening units.

18. A vibratory screening machine comprising an outer frame, an inner frame mounted on said outer frame, a plurality of modular screening units each comprising a screen-supporting surface and an undersize-material receiving chamber underlying each screen-supporting surface individually removable and remountable in stacked and staggered overlying relationship on said inner frame, an undersize-material receiving trough underlying said modular screening units, an outlet duct on each of said chambers, and an inlet duct on said undersize-material receiving trough in communication with each of said outlet ducts.

19. A vibratory screening machine as set forth in claim 18 including an entry portion on each of said inlet ducts, an exit portion on each of said outlet ducts located within each of said entry portions, and a clearance between each of said exit and entry portions.

20. A vibratory screening machine as set forth in claim 19 including a closed top on said undersize-material receiving trough, and said inlet ducts extending upwardly through said closed top.

21. A vibratory screening machine as set forth in claim 18 including a closed top on said undersize-material receiving trough, and said inlet ducts extending upwardly through said closed top.

22. A vibratory screening machine comprising an outer frame, an inner frame mounted on said outer frame, a plurality of modular screening units each comprising a screen-supporting surface and an undersize-material receiving chamber underlying each screen-supporting surface individually removable and remountable in stacked and staggered overlying relationship on said inner frame, and an individual liquid feed distribution member associated with each of said screening units.

23. A vibratory screening machine comprising an outer frame, an inner frame mounted on said outer frame, a plurality of screening units mounted in stacked and staggered relationship on said inner frame, each of said screening units including a screen-supporting surface and an undersize-material receiving chamber underlying said screen-supporting surface, an undersize-material receiving trough extending for substantially the entire length of and underlying all of said plurality of screening units, and an oversize-material receiving trough underlying said undersize-material receiving trough.

24. A vibratory screening machine as set forth in claim 23 including a screen on each of said screening units.

25. A vibratory screening machine as set forth in claim 24 wherein each of said screens overlies at least a portion of an adjacent screen.

26. A vibratory screening machine comprising an outer frame, an inner frame mounted on said outer frame, said inner and outer frames having a centerline, a plurality of modular screening units mounted on said inner frame and each including a screen-supporting surface and an undersize-material receiving chamber underlying said screen-supporting surface and an outlet duct in communication with said chamber, and means for selectively permitting removal and remounting of individual screening units through said outer frame in a direction transversely of said centerline.

* * * * *